US008408881B2

(12) United States Patent
Crotti et al.

(10) Patent No.: US 8,408,881 B2
(45) Date of Patent: Apr. 2, 2013

(54) ROTARY VACUUM PUMP WITH A DEVICE FOR DECOUPLING THE DRIVING MOTOR

(75) Inventors: Antonio Crotti, Offanengo (IT); Franco Fermini, Offanengo (IT)

(73) Assignee: VHIT S.p.A., Offanengo (IT)

( * ) Notice: Subject to any disclaimer, the term of this patent is extended or adjusted under 35 U.S.C. 154(b) by 0 days.

(21) Appl. No.: 13/257,165

(22) PCT Filed: Mar. 17, 2010

(86) PCT No.: PCT/IB2010/051149

§ 371 (c)(1), (2), (4) Date: Oct. 26, 2011

(87) PCT Pub. No.: WO2010/106505

PCT Pub. Date: Sep. 23, 2010

(65) Prior Publication Data

US 2012/0034107 A1 Feb. 9, 2012

(30) Foreign Application Priority Data

Mar. 17, 2009 (IT) ..... TO2009A0201

(51) Int. Cl.
*F04B 49/00* (2006.01)

(52) U.S. Cl. ..... 417/223; 417/316; 417/319; 417/423.6; 417/410.3

(58) Field of Classification Search ..... 417/223, 417/316, 319, 423.6, 410.3; 418/69; 192/3.57, 192/54.52, 69.6, 69.63, 69.9
See application file for complete search history.

(56) References Cited

U.S. PATENT DOCUMENTS

| | | | | |
|---|---|---|---|---|
| 2,683,420 | A * | 7/1954 | Hill et al. | 417/202 |
| 2,902,205 | A * | 9/1959 | Parker | 417/319 |
| 3,518,031 | A * | 6/1970 | Randall | 417/319 |
| 7,104,765 | B2 * | 9/2006 | Miyaji et al. | 417/223 |
| 2003/0035734 | A1 * | 2/2003 | Vukovich et al. | 417/223 |
| 2003/0108434 | A1 * | 6/2003 | Mohrmann | 417/223 |
| 2007/0253836 | A1 | 11/2007 | Jeon | |

FOREIGN PATENT DOCUMENTS

| | | | |
|---|---|---|---|
| DE | 10 2007 056 316 | A1 | 5/2008 |
| DE | 10 2008 024 441 | A1 | 11/2008 |
| WO | 2006/010528 | A1 | 2/2006 |

* cited by examiner

*Primary Examiner* — Charles Freay
*Assistant Examiner* — Christopher Bobish
(74) *Attorney, Agent, or Firm* — Sughrue Mion, PLLC

(57) ABSTRACT

A rotary vacuum pump comprises, between the rotor (2) and a driving motor, a control unit (1; 101) for operatively connecting the pump and the motor only in the periods in which the pump operation is required or desired. The control unit (1; 101) includes: a rotating member (12; 112) connected to a motor output and arranged to be made integral for rotation with the pump rotor (2, 10) when the pump operation is required or desired; a plurality of coupling elements (17), which are located between the rotating member (12; 112) and an element (10) belonging to or integral for rotation with the pump rotor (2), and which are arranged to take a coupling position or a decoupling position to make the rotating member (12; 112) and the rotor (2) integral for rotation, or to make the rotating member (12; 112) and the rotor (2) independent of each other, respectively; and actuating members (40, 14, 19, 20, 26; 140, 114, 119, 126) for actuating said coupling elements (17), which actuating members are driven by said rotating member (12; 112) so as to take a first position and a second position in the periods where the pump is operating and in the periods where the pump is not operating respectively.

20 Claims, 7 Drawing Sheets

ROTARY VACUUM PUMP WITH A DEVICE FOR DECOUPLING THE DRIVING MOTOR

CROSS REFERENCE TO RELATED APPLICATIONS

This application is a National Stage of International Application No. PCT/IB2010/051149, filed on Mar. 17, 2010, which claims priority from Italian Patent Application No. TO2009A000201, filed on Mar. 17, 2009, the contents of all of which are incorporated herein by reference in their entirety.

TECHNICAL FIELD

The present invention relates to vacuum pumps, and more particularly it concerns a rotary vacuum pump equipped with a control unit arranged to operatively connect the pump to a driving motor only in periods in which the pump operation is required or desired, and to decouple the pump from the motor in other periods.

Preferably, but not exclusively, the present invention is applied in vacuum pumps driven by the motor of a motor vehicle.

PRIOR ART

In the automotive field, pumps, called "vacuum pumps", are used, whose purpose is generating and maintaining a depression in an air tank. This depression mainly serves to operate servo brakes and other apparatuses which need to use a depression for their operation. After the depression has been generated, the activation of these vacuum pumps serves to compensate the vacuum consumption by the apparatuses connected to the vacuum source and the leaks. Since these apparatuses are not permanently in operation and the leaks are reduced, there are periods of time, which may even have a noticeable duration, during which the operation of the pump is of no use. Nevertheless, usually, the vacuum pumps are permanently driven by the motor. The consequence is an unnecessary power absorption and therefore a certain increase in fuel consumption, as well as an unnecessary wear of the pump components.

The activation of the vacuum pump only when its operation is required would allow reducing the total power requested of the motor and therefore the fuel consumption and the exhaust gas emission, as well as reducing the wear of the pump components and therefore increasing their operating life. In addition, alternative and less costly materials could be chosen for manufacturing the pump components, in view of the reduced stresses such components are subjected to.

A pump with a control unit arranged to connect the pump to the motor only in periods in which the pump operation is required and to decouple the pump from the motor when the pump operation is not required is disclosed in WO 2006/010528 in the name of the same Applicant. According to that document, a rotary positive displacement pump is arranged between the driving motor and the vacuum pump rotor and it has a rotor and a stator that are connected with the motor and the vacuum pump rotor, respectively, and that define a pumping chamber missing an outlet, except the leaks due to clearances. The rotor and the stator of such a positive displacement pump jointly rotate, thereby transmitting motion from the motor to the vacuum pump, when a liquid is present in the pumping chamber. When on the contrary the supply to the pumping chamber is stopped and the chamber is evacuated through the clearances, the rotor and the stator of such a positive displacement pump are decoupled from each other thereby decoupling the pump from the motor.

The main drawback of the prior art pump is its high inertia, at the decoupling and the coupling, inherent in the wholly hydraulic operation. This inertia also entails the risk that the pump is not timely disconnected from the motor at the moment of a possible counter-rotation of the motor itself, or that it does not become connected, with a consequent delay in vacuum generation.

It is an object of the present invention to provide a vacuum pump equipped with a control unit of the kind discussed above, which allows a quick transition between the coupled and decoupled condition and vice versa.

According to the invention, this is achieved by a vacuum pump having the features set forth in the appended claim 1.

Advantageously, the coupling elements comprise rolling elements that are located in variable-depth seats defined between facing surfaces of the rotating member and the element belonging to or integral for rotation with the pump rotor and that have a diameter having an intermediate value between a maximum and a minimum depth of said seats. In the coupling position, the rolling elements are located in a region of their respective seats where the depth is such that the elements mechanically interfere with the facing surfaces, and in the decoupling position the rolling elements are located in a region of their respective seats where the seat depth exceeds the diameter of the elements.

According to another advantageous feature of the invention, the actuating members are hydraulically driven for moving from their first to their second position, and are hydraulically or mechanically driven for moving from their second to their first position.

The invention also concerns a method of controlling a vacuum pump, as claimed in the appended claim 18.

BRIEF DESCRIPTION OF THE DRAWINGS

The invention will now be described in greater detail with reference to the accompanying drawings, which show some preferred embodiments given by way of non limiting examples and in which.

DETAILED DESCRIPTION

A first exemplary embodiment of a vacuum pump according to the present invention is shown in FIGS. 1 to 7.

Figure 1:
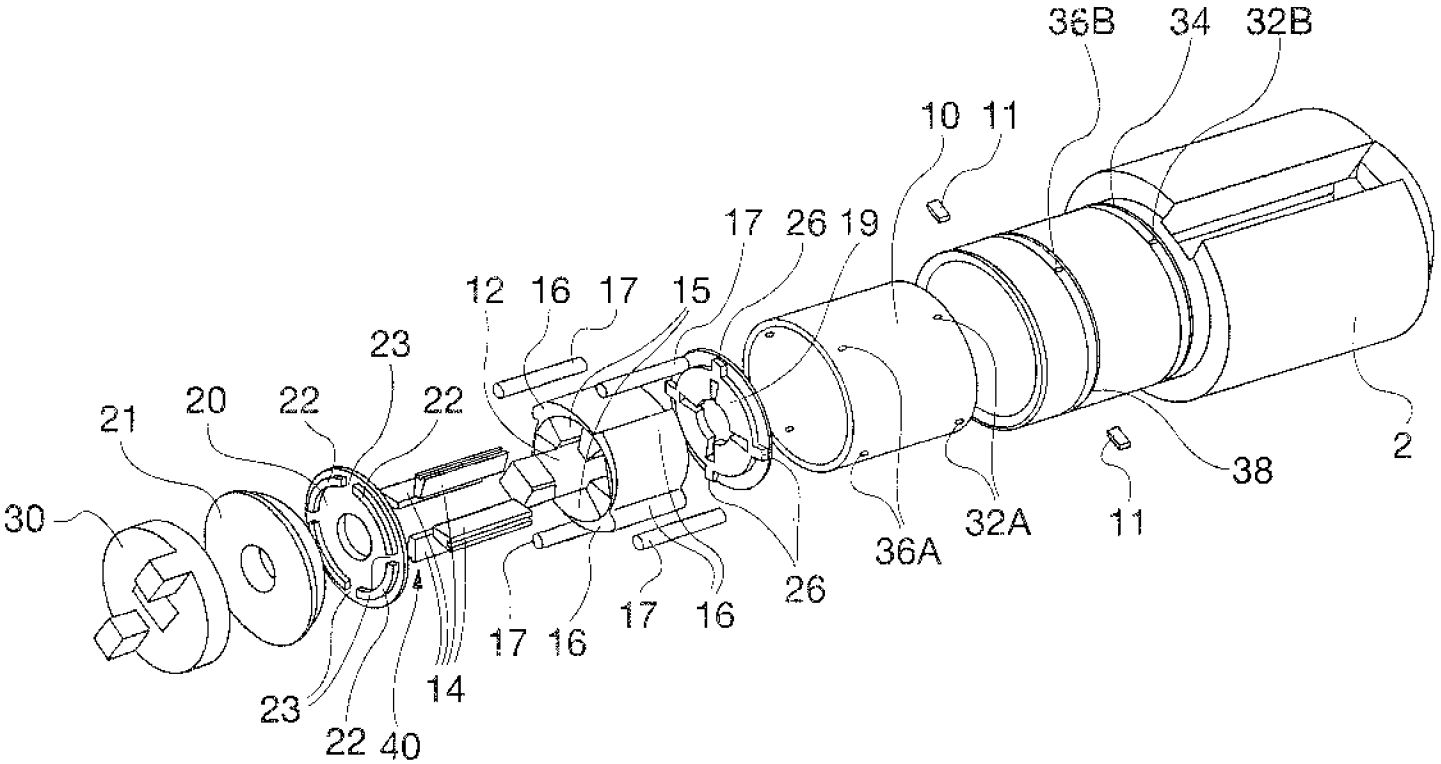
FIG. 1 is an exploded view of a pump rotor and of a control unit relating to a first exemplary embodiment of a vacuum pump according to the invention.
Figure 2:
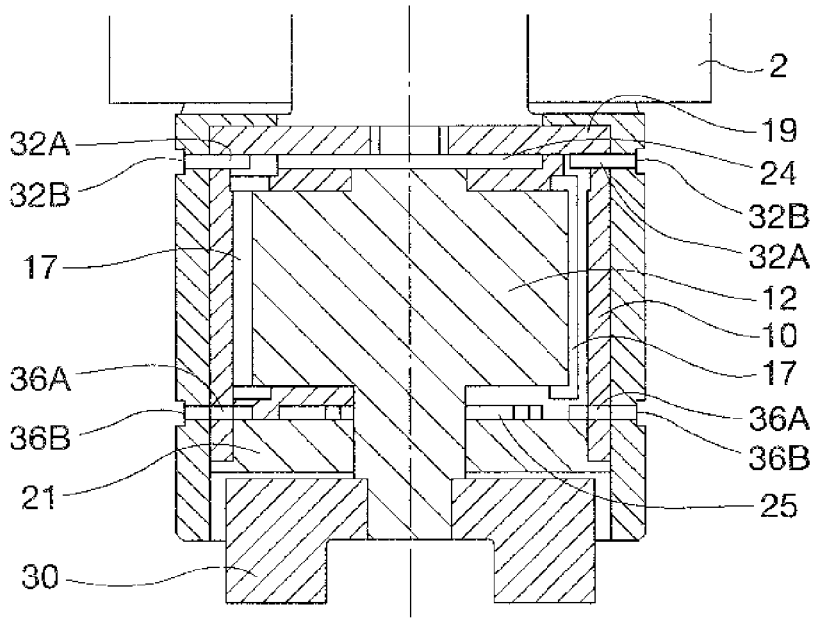
FIG. 2 is an axial sectional view of the pump rotor and the control unit depicted in FIG. 1, shown in assembled condition.
Figure 3:
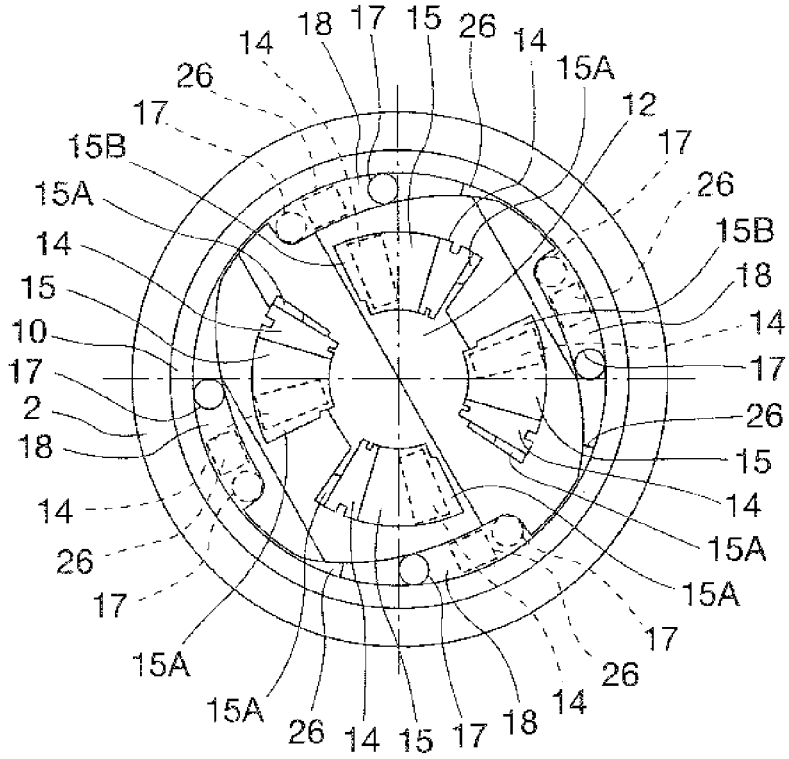
FIG. 3 is a cross-sectional view of the control unit shown in the previous Figures, showing the arrangement of its components in the operating and idle conditions of the pump.

Referring to FIGS. 1 to 3, a control unit, generally designated by reference numeral 1, is inserted between rotor 2 of a vacuum pump and a pump driving motor (not shown), for instance the engine of a motor vehicle, and is arranged to decouple the pump from the motor when the operation of the pump itself is not required or desired.

Control unit 1 comprises a bushing or cylindrical body 10 that is housed within pump rotor 2 and is made integral for rotation therewith by means of fastening pegs 11, and an internal rotor 12 that is housed within bushing 10 and is made to rotate by said motor through a drive joint 30. From the operating standpoint, bushing 10 can be considered as a part of pump rotor 2, and internal rotor 12 can be considered as a part of the motor.

Internal rotor 12 is configured so as to have a plurality of internal cavities 15, four in the illustrated example. The external surface of rotor 12 is shaped as a ratchet gear and has a succession of variable-thickness projections 16 defining, with the internal wall of bushing 10, variable-depth chambers 18 (FIG. 3). Chambers 18 house coupling elements 17. Preferably, the coupling elements are rolling members, e.g. rollers 17 having a diameter with an intermediate value between the minimum and the maximum depth of chambers 18 and arranged to roll along the floor of chambers 18.

Rollers 17 form elements for the mechanical coupling of internal rotor 12 with pump rotor 2. The position of rollers 17 in chambers 18 depends on whether or not motion is to be transmitted to pump rotor 2. More particularly, referring to FIG. 3, when motion is to be transmitted to pump rotor 2, rollers 17 are located in a region of chambers 18 where the rollers interfere with the internal surface of bushing 10 and the external surface of internal to rotor 12 (as depicted in solid lines). On the contrary, when motion is not to be transmitted to pump rotor 2, the rollers are located in a region where the depth of chambers 18 exceeds the roller diameter, whereby the rollers are not in contact with the internal surface of bushing 10 (as depicted in dashed lines).

Turning back to FIG. 1, bushing 10 further has associated therewith an upper cover 19, a lower cover 20 and a ring 21, which is mounted with interference on bushing 10 and keeps control unit 1 assembled. Both the covers and the ring have respective central holes through which the ends of internal rotor 12 pass. Covers 19, 20 are rigidly connected by a member 40 equipped with a plurality of radial vanes 14, the number of which is the same as the number of cavities 15 of internal rotor 12. Vanes 14 are each housed in a respective one of cavities 15, are displaceable therein and divide the cavities into two partial cavities 15A and 15B, respectively, intended to be alternatively filled with a drive liquid, for instance the oil for motor lubrication. More particularly, partial cavities 15A contain oil in the phases in which the vacuum pump is not operating, and partial cavities 15B contain oil in the phases in which the vacuum pump is operating. The confronting surfaces of covers 19, 20 are equipped with teeth or fins 26 (visible only for upper cover 19) arranged to cooperate with rollers 17 in a manner depending on the operating conditions of the pump.

Vanes 14 of member 40 and teeth 26 of covers 19, 20 form members for the mechanical actuation of rollers 17, which position the rollers in the condition of motion transmission or non-transmission to pump rotor 2, at it will be better disclosed further on.

The surfaces of covers 19, 20 directed away from vanes 14 have in turn a set of circumferential projections 22 (visible only for lower cover 20), which, in assembled condition of the control unit, are in contact with the bottom of bushing 10 and ring 21, respectively. Those projections define, with the internal side wall of bushing 10 and the bottom of bushing 10 or ring 21, an upper chamber 24 and a lower chamber 25 (FIG. 2) in communication with partial cavities 15B and 15A, respectively, through passageways 23 (FIG. 1), they too visible only for lower cover 20, which separate adjacent projections 22. Upper chamber 24 receives oil through openings 32A in bushing 10 and openings 32B provided in the bottom of a first groove 34 of pump rotor 2. Similarly, lower chamber 25 receives oil through openings 36A in bushing 10 and openings 36B provided in the bottom of a second groove 38 of rotor 2.

The oil outflow from upper chamber 24 is not shown. Such an outflow can exploit the usual leakage or suitable ducts bringing the oil back towards the motor.

Figure 4:
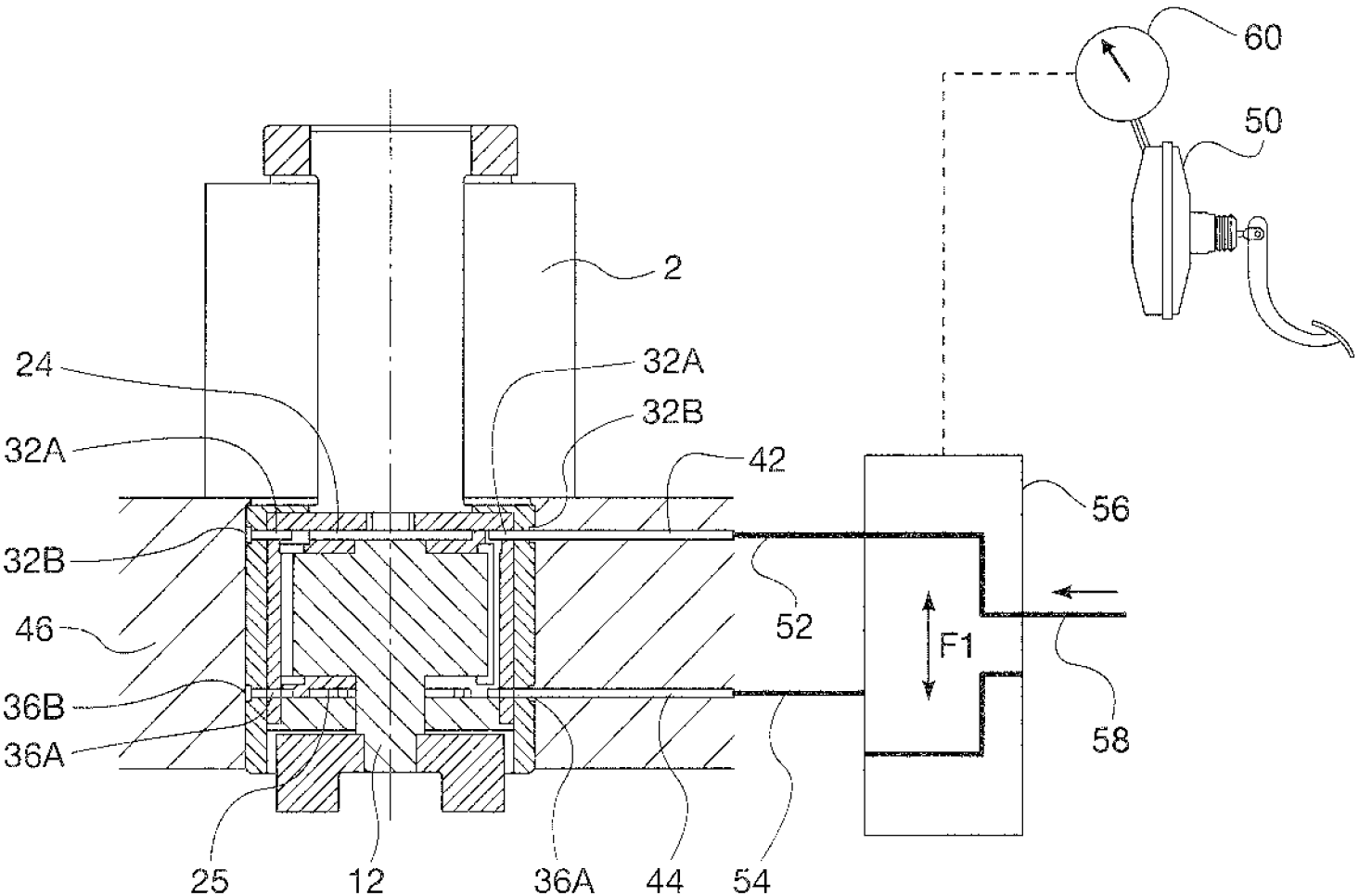
FIG. 4 is a diagram of the hydraulic supply circuit of the control unit shown in the previous Figures.

FIG. 4 shows the hydraulic circuit for supplying chambers 24, 25 with oil, in the exemplary case of a pump actuating a servo brake 50 of a motor vehicle. Elements already described with reference to the previous Figures are denoted by the same reference numerals. As shown, upper chamber 24 and lower chamber 25 are connected, through openings 32A, 32B and 36A, 36B, with ducts 42 and 44, respectively, formed in pump support 46 and connected in turn to respective outlets 52, 54 of a valve 56 with one inlet and two outlets, for instance a slide valve, of which inlet 58 is connected to the lubrication circuit of the vehicle motor. The slide of valve 56 can be made to shift, as shown by arrow F1, by signals supplied by a pressure detector 60 connected to servo brake 50, in order to set up the connection between valve inlet 58 and either duct 42, 44, depending on whether the vacuum degree in the servo brake circuit corresponds to a steady state value (in which case the pump can be decoupled from the motor) or is different from such a value. The Figure shows valve 56 in the decoupled condition.

Figure 5:
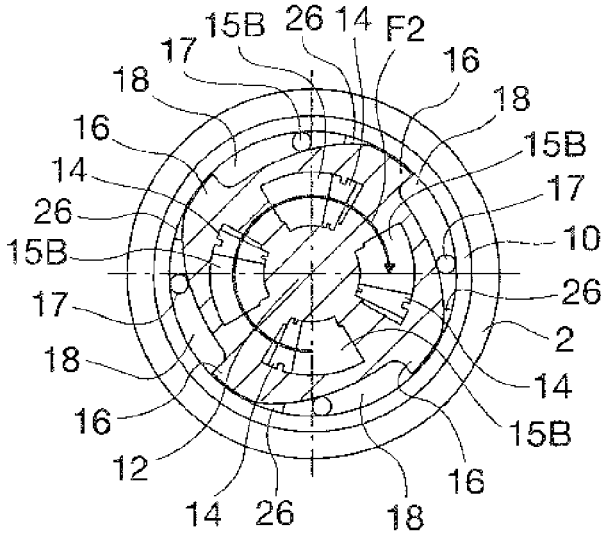
FIGS. 5 to 7 are views similar to FIG. 3, in three different operating conditions of the control unit.
Figure 6:
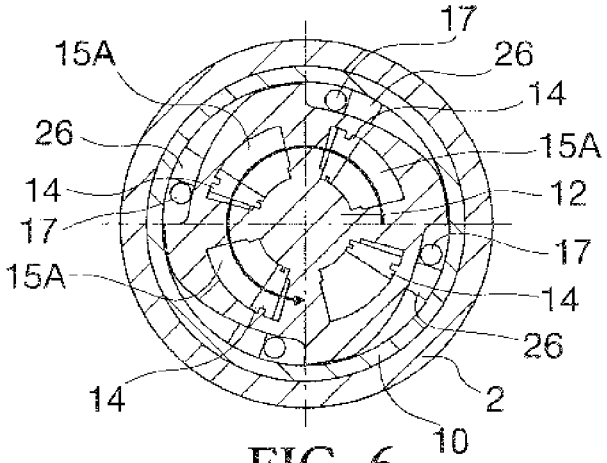
Figure 7:
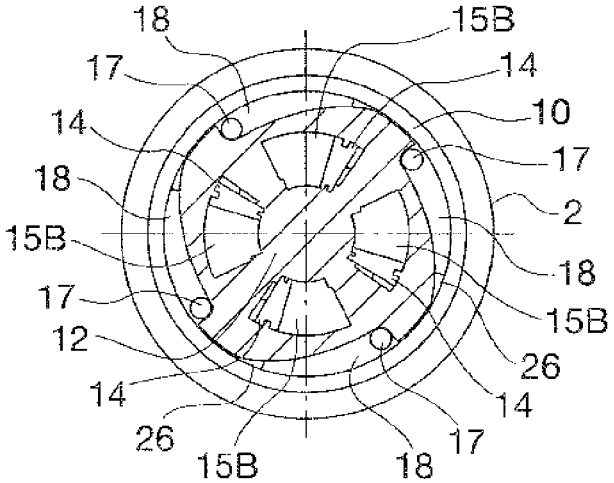

The operation of the control unit will be now described with reference to FIGS. 5 to 7. For such a description, it is assumed that the normal rotation direction of internal rotor 12 and pump rotor 2, when the pump is operating, is the counterclockwise direction.

When the vehicle is started, and as long as the vacuum in the circuit of servo brake 50 (FIG. 4) has not reached the steady state value, the signal supplied by detector 60 sets the slide of valve 56 so that inlet 58 is connected to outlet 52, so that the valve lets oil pass to duct 42 and hence to upper chamber 24 (FIGS. 2, 4). Oil passes from upper chamber 24 into partial cavities 15B of internal rotor 12, as shown in FIG. 5, and the pressure exerted by the oil on vanes 14 due to the rotation of internal rotor 12 causes such vanes to move in opposite direction to the rotor, hence in clockwise direction in the present example, as shown by arrow F2 in FIG. 5. The clockwise rotation of vanes 14 drags in clockwise direction also covers 19, 20 (FIG. 1), whereby teeth 26 move away from rollers 17, which can thus freely move in the respective chamber 18 and follow the motion of internal rotor 12. Since the latter, as stated, usually rotates in opposite direction to arrow F2, such a rotation brings rollers 17 towards the narrower region of chambers 18 and the rollers, when reaching the point where the depth of the chambers is equal to the roller diameter, will produce an interference between internal rotor 12 and bushing 10, thereby making them integral for rotation and keeping pump rotor 2 connected to the driving motor. The counterclockwise rotation of internal rotor 12 ensures that interference is maintained. This condition is a first operating position of the actuating members disclosed above, in which said members let each roller 17 free to move in a direction depending on the rotation direction of internal rotor 12, so as to make such internal rotor 12 and pump rotor 2 integral for rotation (coupling position of rollers 17).

When the steady state value of the vacuum is attained, the pump can be disconnected from the motor. Detector 60 (FIG. 4), upon detecting that such a value has been attained, generates a signal making the slide of valve 56 switch so as to put inlet 58 in communication with outlet 54, so that the valve lets oil pass to duct 44 and hence to lower chamber 25 (FIGS. 2, 4). Oil passes from lower chamber 25 into partial cavities 15A of internal rotor 12, as shown in FIG. 6. The rotation of internal rotor 12 pushes oil against vanes 14 and now causes such vanes to move in counterclockwise direction in cavities 15, as shown by arrow F3 in FIG. 6, while causing oil previously contained in cavities 15B to outflow. The counterclockwise rotation of vanes 14 drags in counterclockwise direction also covers 19, 20 (arrow F3 in FIG. 6), whereby teeth 26 arrive in contact with rollers 17 and drag them towards the deeper region of chambers 18. When the rollers reach a point where the depth of chambers 18 exceeds the roller diameter, bushing 10 (and hence pump rotor 2) is no longer integral with internal rotor 12 and the pump is disconnected from the motor. This condition is a second operating position of the actuating members disclosed above, in which said members bring rollers 17 to a configuration in which internal rotor 12 is independent, in respect of rotation, from pump rotor 2 (decoupling position of rollers 17).

Thanks to the mechanical dragging of rollers 17, their interference with the facing surfaces of internal rotor 12 and bushing 10 ceases as soon as the rollers reach a region of chambers 18 where the depth exceeds the roller diameter: therefore, the transition from the coupled to the decoupled condition of the pump and the motor does not require the complete filling of cavities 15A (or the complete emptying of cavities 15B) and consequently it is much faster than the transition attainable with the prior art.

This condition is maintained as long as the vacuum substantially has the steady state value. When the pressure exceeds again a certain threshold, so that the pump is to be operated again, the detector makes valve 56 (FIG. 4) switch again, thereby supplying again upper chamber 24 with oil and setting the conditions shown in FIG. 5 again up. The considerations made above in respect of the transition rapidity apply also in this case.

As known, during pump operation it might happen that, for some reason, the driving motor and internal rotor 12 rotate in opposite direction to the normal rotation direction of the pump (counter-rotation), that is, in clockwise direction in the present example. When this occurs, it is necessary to quickly decouple the pump from the motor to avoid damages to the pump itself. This situation is depicted in FIG. 7. Since the pump is operating, oil is still present in cavities 15B and hence teeth 26 are disengaged from rollers 17, which therefore can follow the rotation of internal rotor 12. Since internal rotor 12 is now rotating in clockwise direction, rollers 17 move away from the region of interference with bushing 10 and move again towards the region of maximum depth of chambers 18, so that the pump is disconnected again from the motor and damages are avoided. Since it is not necessary to reverse the oil supply to control unit 1, the decoupling is substantially immediate.

It is also to be appreciated that, in case neither chamber 24, 25 is supplied with oil, rollers 17 can however follow the motion of the rotor, since they are not in engagement with teeth 26, and hence they will allow the possible actuation of the pump by the motor.

The present invention further implements a method of controlling a vacuum pump. The method comprises the steps of:

providing, between the pump and the driving motor, and more particularly between elements 10, 12 functionally belonging to pump rotor 2 and to the motor, respectively, a control unit 1 arranged to operatively connect the pump to the motor only in the periods when the pump operation is required or desired, and to decouple the pump from the motor in other periods;

detecting first and second operating conditions, in which the pump operation is or is not required or desired;

upon detection of the first operating conditions, acting on control unit 1 in order coupling elements 17 provided in the same control unit are made free to displace in a direction depending on the rotation direction of the motor and are brought to a first position in which they set up said connection of the motor with the pump, if the motor rotates in a direction required for pumping, or to a second position, in which the pump is decoupled from the motor, if the motor rotates in a direction opposed to the direction required for pumping; preferably, this is obtained by introducing a drive liquid into a first chamber 24, 15B of control unit 1 and by applying a pressure on the drive liquid in a first direction, in order to disengage actuating means 26 from the coupling elements 17;

upon detection of the second operating conditions, bringing coupling elements 17 to their second position; this is obtained by introducing the drive liquid into a second chamber 25, 15A of control unit 1 and by applying a pressure on the drive liquid in a second direction, opposite to the first direction, in order to bring the actuating means 26 into engagement with the coupling elements 17.

Figure 8:
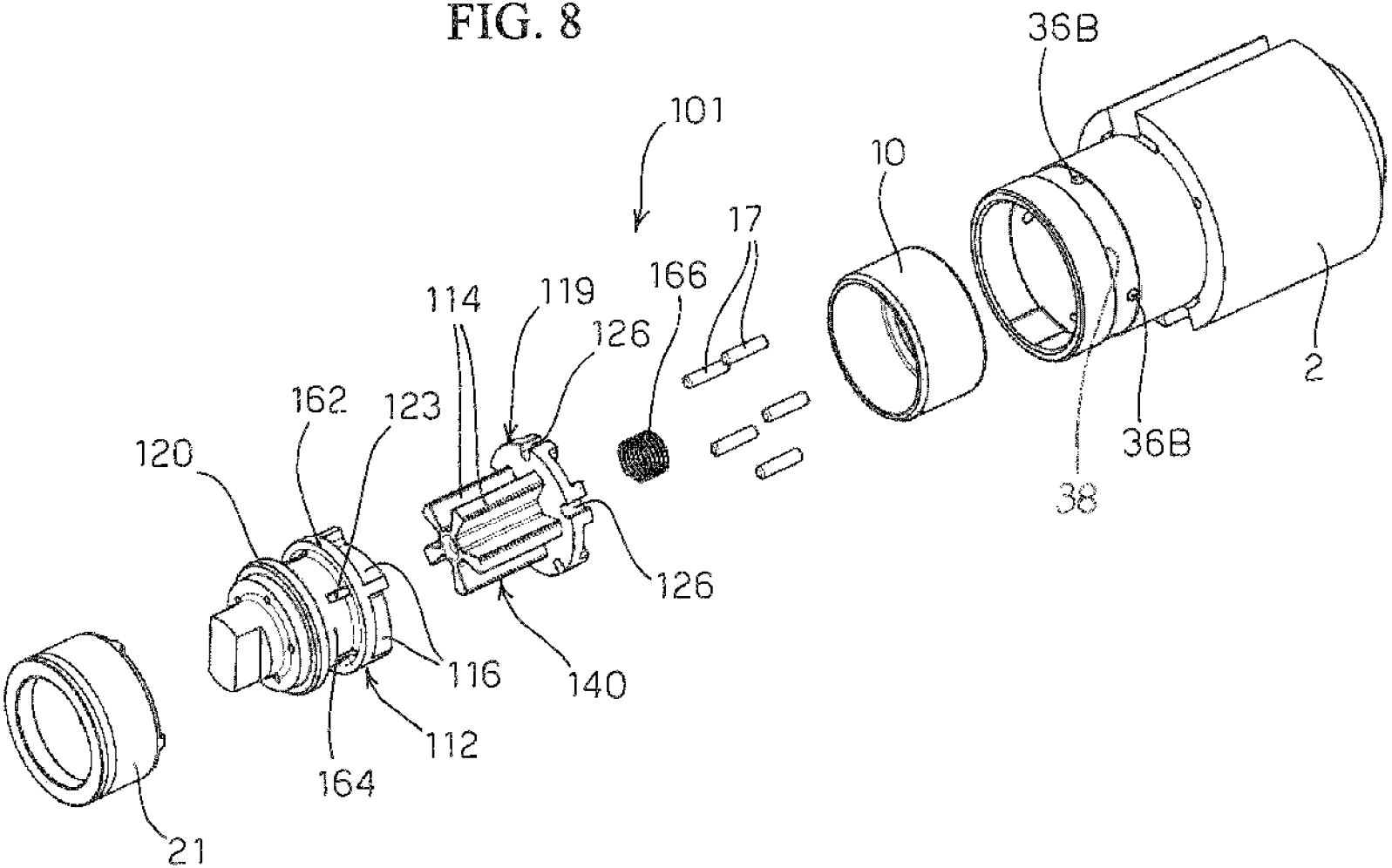
FIG. 8 is an exploded view of a pump rotor and of a control unit relating to a second exemplary embodiment of a vacuum pump according to the invention.
Figure 9:
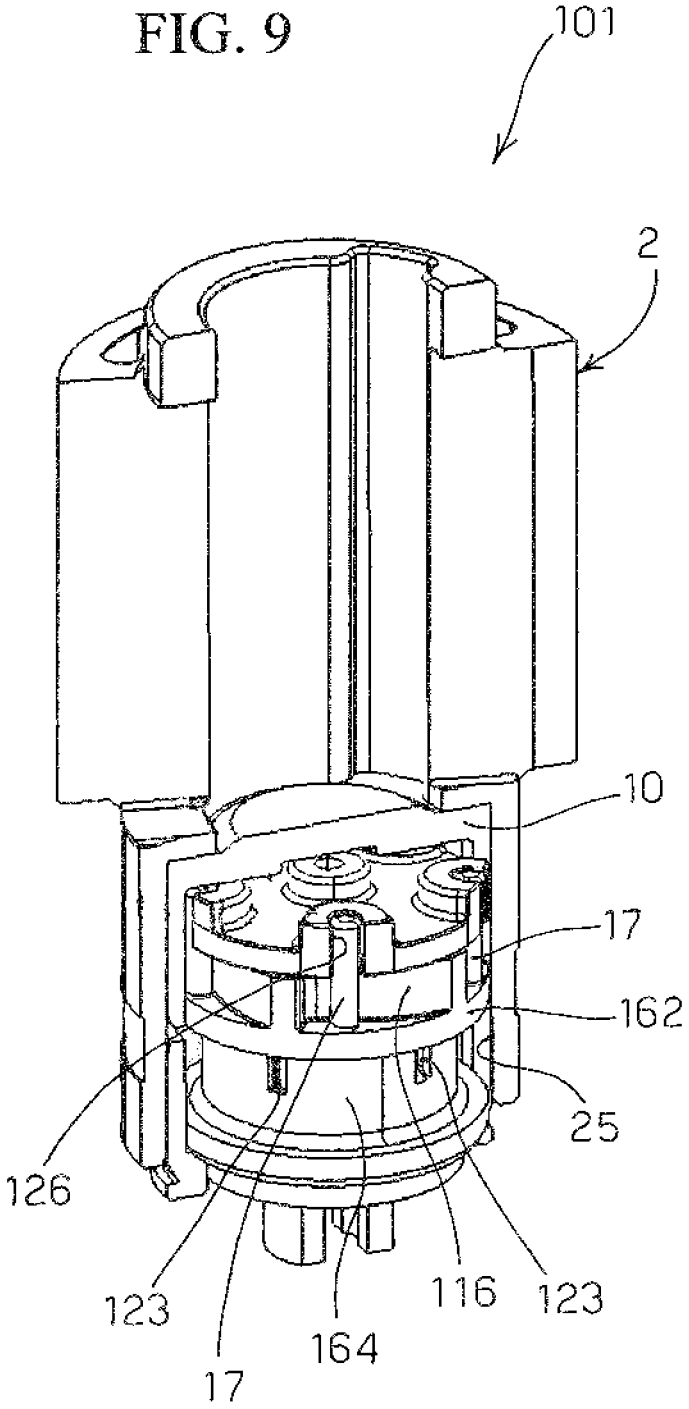
FIG. 9 is a perspective, partially broken away view of the pump rotor and the control unit depicted in FIG. 8.
Figure 10:
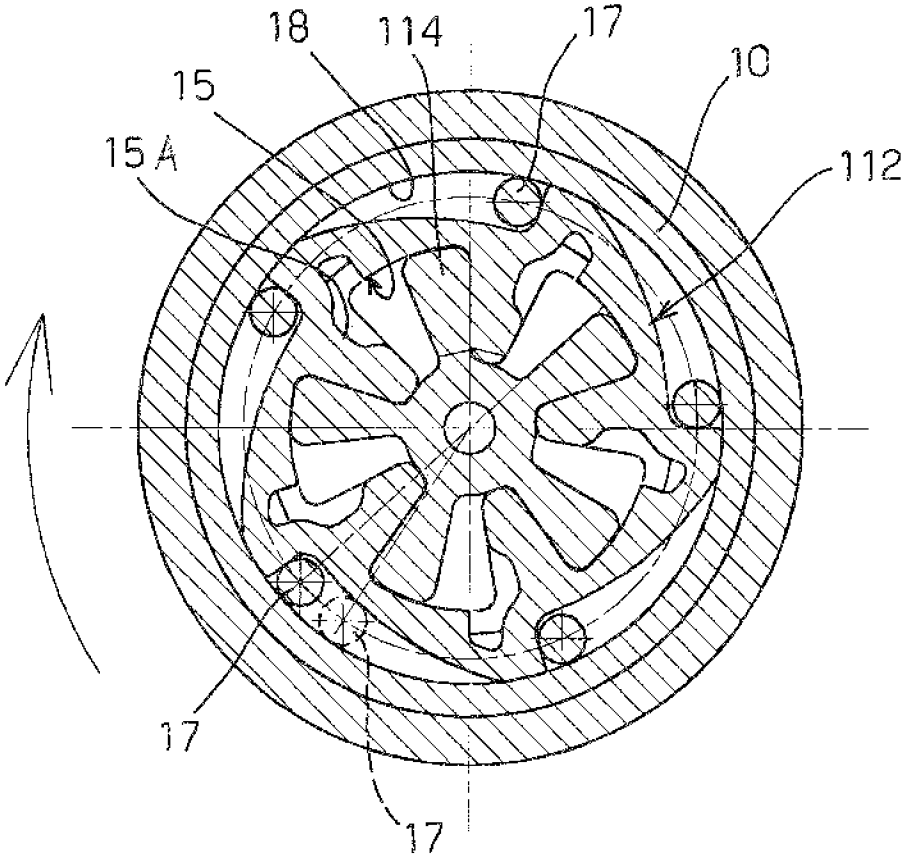
FIG. 10 is a cross-sectional view of the pump rotor and the control unit shown in FIGS. 8 and 9, showing the arrangement of their components in the operating and idle conditions of the pump.

Referring to FIGS. 8 to 10, there is shown a second exemplary embodiment of the present invention.

The same alpha-numerical references are associated with parts and elements similar, or having similar functions, to those of the previously disclosed embodiment. For sake of conciseness, the description of such parts and elements is not repeated once more hereinafter, and reference is made to what disclosed in the description of the first embodiment.

Parts and elements exhibiting substantial differences with respect to the first embodiment from the structural and/or functional standpoint are designated by the same alpha-numerical references increased by 100.

Parts and elements that were not present in the first embodiment are associated with reference numerals representing a continuation, increased by 100, of the numbering used in connection with such a first embodiment.

Contrary to the first embodiment, internal rotor 112 is rigidly connected with cover 120.

Contrary to the first embodiment, cover 119 is rigidly connected with an axial end of radial vanes 114, so as to form a body (that preferably can be manufactured as a single piece), denoted 140 in this embodiment. When rotor 112 and body 140 are coupled together, they form the plurality of cavities 15A and 15B.

In the second embodiment, covers 119, 120 do not have central holes through which the ends of internal rotor 112 pass.

Contrary to the first embodiment, covers 119, 120 are not equipped with the teeth or fins denoted 26 in the first embodiment. On the contrary, cover 119 only is equipped with a plurality of seats 126 where rollers or coupling elements 17 are housed. Preferably, seats 126 are formed as radial recesses. Contrary to what disclosed in connection with the first embodiment, during operation of the pump according to the second embodiment rollers 17 are always in engagement with their seats 126 in order to remain integral for rotation with cover 119.

Contrary to the first embodiment, upper chamber 24 is missing and the first cover 119 does not have the circumferential projections 22.

Contrary to the first embodiment, the second cover 120 does not have the circumferential projections 22 for defining the lower chamber 25. Internal rotor 112 has instead a first section including the set or crown of variable-thickness projections 116 and axially joining with a radial partition flange 162. Moreover, the internal rotor has a second to section axially extending from radial flange 162 and including a neck 164, of reduced diameter, ending at cover 120 with enlarged diameter. Thus, said lower chamber 25 is defined between cover 120, neck 164, radial flange 162 and the side walls of bushing 10.

Preferably in this embodiment internal rotor 112 forms an integral unit with cover 120 and the set or crown of projections 116.

Contrary to the first embodiment, lower chamber 25 communicates with partial cavities 15A through radial slots 123 formed in the side surface of neck 164, and not through the passageways 23.

Contrary to the representation in FIG. 3, dashed lines in FIG. 10 denote the location of rollers 17 in a region of chamber 18 where they interfere with the internal surface of bushing 10 and the external surface of internal rotor 112, and solid lines denote the location of rollers 17 in a region of chamber 18 where they are not in contact with the internal surface of bushing 10.

Similarly to the first embodiment shown, bushing or cylindrical body 10 is equipped with the plurality of openings denoted 36A in FIG. 1 and cooperating with openings 36B in pump rotor 2. Yet, openings 36A are not visible in FIGS. 8 to 10, and only some of the openings 36B located at the bottom and communicating with chamber 25 are visible.

Contrary to the first embodiment, openings 32A and 32B are missing, since upper chamber 24 is not provided in this second embodiment.

Contrary to the first embodiment shown, a thrust spring 166 is arranged between the bottom of bushing 110 and cover 119 in order to keep the assembly consisting of cover 119 and radial vanes 114 in axial abutment against internal rotor 112.

In this embodiment, vanes 114 of body 140 and seats 126 formed in cover 119 form the mechanical actuating members taking the first and the second position and consequently bringing rollers 17 in the coupling position and the decoupling position, respectively.

The hydraulic circuit for supplying chamber 25 with oil is substantially the same as shown in FIG. 4. Contrary to the first embodiment, in the first position of the actuating members valve 56 does not put inlet 58 in communication with duct 42 (which is missing), but it allows supplying oil directly into the vacuum pump and stops the supply to chamber 25 and partial cavities 15A.

In this embodiment, the passage of the actuating members from the second to the first position does not take place by the action of oil inflowing into a chamber (hydraulic drive), but due to the inertia of body 140 (mechanical drive), as it will be disclosed in more detail hereinbelow. In such case, the slide of valve 56 puts inlet 58 directly in communication with the vacuum pump and stops instead oil supply to lower chamber 25 and partial cavities 15A. Consequently, since there is no longer the resistance of oil entering from inlet 58, the rotation of internal rotor 112 makes radial vanes 114 push oil out from chamber 25 and partial cavities 15A. At the same time, body 140 rotates by inertia in a rotation direction opposite to that of internal rotor 112 and firmly makes rollers 17 rotate in seats 18 in interference with bushing 10. In this manner, the passage of the actuating members from the second to the first position and of rollers 17 from the decoupling to the coupling position has been obtained.

The passage of the actuating members from the first to the second position substantially takes place in similar manner to what has been disclosed for the first embodiment, that is by filling chamber 25 and partial cavities 15A with an oil flow controlled by valve 56 (hydraulic drive) through duct 44. Yet, rollers 17 are always integral for rotation with body 140 during the different operating phases of the pump, without using teeth or fins 26 of the first embodiment.

Similar or functionally equivalent features in the different variants and embodiments described and shown can be freely mutually exchanged, provided they are compatible.

It is clear that the above description has been given only by way of non-limiting example and that changes and modifications are possible without departing from the scope of the invention as set forth in the following claims.

In particular, bushing 10 (which from an operating standpoint is part of pump rotor 2) is not required when pump rotor 2 is made of a material that is not subjected to wear because of the interference with rollers 17 (which are made e.g. of steel), and its function is performed by an internal surface of the rotor itself.

Moreover, the coupling elements can also be elements different from rollers 17, such as for instance rigid elements with a square cross-section, or generally a cross section that needs not to be circular, having a thickness suitable for the interference with bushing 10.

The invention claimed is:

1. A rotary vacuum pump having a rotor and comprising, between the rotor and a driving motor, a control unit for operatively connecting the rotor to the motor only in periods in which the pump operation is required or desired, and for decoupling the pump from the motor in other periods, said control unit including a rotating member connectable to a motor output and arranged to be made integral for rotation with the pump rotor when the pump operation is required or desired, and to be disconnected from the rotor in the other periods;—a plurality of mechanical coupling elements, which are located between the rotating member and an element belonging to or integral for rotation with the pump rotor, and are arranged to take a coupling position in which they make the rotating member and the rotor integral for rotation, and a decoupling position in which they make the rotating member and the rotor independent of each other;

actuating members hydraulically driven for mechanically actuating said coupling elements, which members are driven by said rotating member so as to take, in the periods where the pump is operating, a first position, in which the actuating members let said coupling elements freely displace in a direction depending on the rotation direction of the rotating member in order the coupling elements move to the coupling position, if the rotating member rotates in a direction required for the pump operation, or to the decoupling position, if the rotating member rotates in a direction opposed to the direction required for the pump operation, and so as to take, in the periods where the pump is not operating, a second position, in which said actuating members bring said coupling elements to the decoupling position; and in that the pump further includes:

means for supplying liquid for the hydraulic drive of the actuating members, and wherein the rotating member defines, together with the actuating members, at least one chamber for containing said liquid, and wherein the supply means are arranged to supply with the liquid said at least one chamber when the actuating members are to be brought to or kept in their second position.

2. The pump as claimed in claim 1, wherein said actuating members are disengaged from said coupling elements in said first position and are in engagement with said coupling elements in said second position.

3. The pump as claimed in claim 1, wherein said actuating members are in engagement with said coupling elements in both said first and second positions.

4. The pump as claimed in claim 1, wherein the coupling elements are located in variable-depth seats defined between the rotating member and an internal surface of the element belonging to or integral for rotation with the pump rotor and have a diameter or a thickness having an intermediate value between a maximum and a minimum depth of said seats.

5. The pump as claimed in claim 2, wherein the coupling elements are located in variable-depth seats defined between the rotating member and an internal surface of the element belonging to or integral for rotation with the pump rotor and have a diameter or a thickness having an intermediate value between a maximum and a minimum depth of said seats.

6. The pump as claimed in claim 3, wherein the coupling elements are located in variable-depth seats defined between the rotating member and an internal surface of the element belonging to or integral for rotation with the pump rotor and have a diameter or a thickness having an intermediate value between a maximum and a minimum depth of said seats.

7. The pump as claimed in claim 1, wherein, in the coupling position, the coupling elements are located in a region of their respective seats where the depth is such that the coupling elements mechanically interfere with facing surfaces of the rotating member and the element belonging to or integral for rotation with the pump rotor and, in the decoupling position, the coupling elements are located in a region of their respective seats where the seat depth exceeds the diameter or thickness thereof.

8. The pump as claimed in claim 2, wherein, in the coupling position, the coupling elements are located in a region of their respective seats where the depth is such that the coupling elements mechanically interfere with facing surfaces of the rotating member and the element belonging to or integral for rotation with the pump rotor and, in the decoupling position, the coupling elements are located in a region of their respective seats where the seat depth exceeds the diameter or thickness thereof.

9. The pump as claimed in claim 3, wherein, in the coupling position, the coupling elements are located in a region of their respective seats where the depth is such that the coupling elements mechanically interfere with facing surfaces of the rotating member and the element belonging to or integral for rotation with the pump rotor and, in the decoupling position, the coupling elements are located in a region of their respective seats where the seat depth exceeds the diameter or thickness thereof.

10. The pump as claimed in claim 1, wherein said rotating member defines, with the actuating members, a single chamber for containing said liquid.

11. The pump as claimed in claim 10, wherein the rotating member has a plurality of internal cavities each of which is divided into a first and a second partial cavity by elements belonging to said actuating members, the second partial cavities communicating with said chamber.

12. The pump as claimed in claim 11, wherein said actuating members comprise:

a plurality of radial vanes, which are each received in a respective cavity of the rotating member, are arranged to divide said cavities into the respective first and second partial cavities and are displaced within the respective cavity, because of a pressure applied by the drive liquid onto the rotating member, in the same direction as the rotation direction of the rotating member when the supply means supply the chamber with liquid; and a pair of closing elements for said chamber and said cavities, at least one of said closing elements being rigidly connected to the vanes at one end thereof and being equipped with engagement means which engage the coupling elements at least in the second position of the actuating members.

13. The pump as claimed in claim 12, wherein the other closing element is rigidly connected to the rotating member.

14. The pump as claimed in claim 12, wherein said engagement means comprise a plurality of seats in which said coupling elements are coupled.

15. The pump as claimed in claim 13, wherein said engagement means comprise a plurality of seats in which said coupling elements are coupled.

16. The pump as claimed in claim 1, wherein said rotating member defines, with the actuating members, a first and a second chamber for containing said liquid, and the supply means are arranged to supply with the liquid the first or the second chamber, respectively, when the actuating members are to be brought to or kept in their first or second position, respectively.

17. The pump as claimed in claim 16, wherein the rotating member has a plurality of internal cavities each of which is divided into a first and a second partial cavity by elements belonging to said actuating members, the first and second partial cavities communicating with the first and the second chamber, respectively.

18. The pump as claimed in claim 17, wherein said actuating members comprise:

a plurality of radial vanes, which are each received in a respective cavity of the rotating member, are arranged to divide said cavities into the respective first and second partial cavities and are displaced within the respective cavity, because of a pressure applied by the drive liquid onto the rotating member, in the same direction as or in opposite direction to the rotation direction of the rotating member, respectively, depending on whether the supply means supply the first or the second chamber with liquid; and a pair of closing elements for said chambers and said cavities, which closing elements are mounted at ends of the vanes and are equipped with engagement means arranged to engage the coupling elements in the second position of the actuating members.

19. A method of controlling a rotary vacuum pump, comprising the steps of:

providing, between the pump and a driving motor thereof, a control unit arranged to couple the pump with the motor only in periods where the pump operation is required or desired, and to decouple the pump from the motor in other periods;

detecting first and second operating conditions of the pump, corresponding to the periods where the pump operation is required or desired and to the other periods, respectively; and actuating the control unit so that it takes a first or a second configuration, depending on whether the first or the second operating conditions are detected; and upon detection of the first operating conditions, making coupling elements provided in the control unit free to displace in a direction depending on the rotation direction of the motor, in order said elements move to a first position in which they couple the motor with the pump, if the motor rotates in a direction required for pumping, or to a second position, in which the pump is decoupled from the motor, if the motor rotates in a direction opposed to the direction required for pumping; and upon detection of the second operating conditions, bringing the coupling elements to their second position;

wherein said step of making the coupling elements free to displace includes:

introducing a drive liquid into a first chamber of the control unit; and applying a pressure on the drive liquid in a first direction, in order to disengage the actuating members from the coupling elements;

and said step of bringing the coupling elements includes:

introducing a drive liquid into a second chamber of the control unit; and applying a pressure on the drive liquid in a second direction, opposite to the first direction, in order to make the actuating members free to displace and to engage the coupling elements.

20. The method as claimed in claim 19, wherein said step of bringing the coupling elements includes:

introducing a drive liquid into a chamber of the control unit; and applying a pressure on the drive liquid in a direction, in order to disengage the actuating members from the coupling elements.

* * * * *